United States Patent [19]

Matt et al.

[11] Patent Number: 4,640,452

[45] Date of Patent: Feb. 3, 1987

[54] DEVICE FOR DRIVING NAILS OR SIMILAR FASTENING ELEMENTS

[75] Inventors: Lukas Matt, Mauren, Liechtenstein; Fritz Mark, Mäder, Austria; Hans Gschwend, Vaduz, Liechtenstein

[73] Assignee: Hilti Aktiengesellschaft

[21] Appl. No.: 758,478

[22] Filed: Jul. 24, 1985

[30] Foreign Application Priority Data

Jul. 26, 1984 [DE] Fed. Rep. of Germany ..... 3427614

[51] Int. Cl.[4] ..... B25C 5/06; B25C 5/15

[52] U.S. Cl. ..... 227/131; 173/53; 227/147

[58] Field of Search ..... 227/131, 147; 173/53

[56] References Cited

U.S. PATENT DOCUMENTS

| | | | |
|---|---|---|---|
| 4,161,272 | 7/1979 | Brockl | 227/131 |
| 4,449,660 | 5/1984 | Smith, III | 227/131 X |
| 4,530,454 | 7/1985 | Gloor et al. | 227/131 X |

*Primary Examiner*—Paul A. Bell

*Attorney, Agent, or Firm*—Toren, McGeady, Stanger, Goldberg & Kiel

[57] ABSTRACT

A device for driving nails, staples and similar fastening elements includes an electromotor for rotating a driving member. The rotation of the driving member is transferred to a driven member which, in turn, converts the rotational movement into translational movement. The rotational movement from the driving member to the driven member is effected for a limited time period by a clutch so that a drive stroke and a return stroke are carried out. A releasing device actuates the clutch.

11 Claims, 6 Drawing Figures

DEVICE FOR DRIVING NAILS OR SIMILAR FASTENING ELEMENTS

BACKGROUND OF THE INVENTION

The present invention is directed to a device for driving nails or similar fastening elements and includes a driving member rotated by a motor, a driven member including means for converting rotational movement into translational movement for a driver rod, and a clutch for transmitting torque from the driving member to the driven member.

Driving devices powered by a variety of power sources are known for driving nails or similar fastening elements. For example, compressed air, combustion gases or electrical current may serve as the power source. While compressed air devices provide only a low output and require a supply of compressed air often not available at a construction site, in the case of devices powered by combustion gases there is a certain safety risk due to the danger of explosion of the gases. Electrically driven devices do not have any of these disadvantages. A known driving device, powered by an electric motor, has a driving member rotated by the motor and an output member which can be coupled with it for the transmission of the rotational movement. The output or driven member is connected with a driver rod by a part in the form a coiled flat spring. When the driven end is rotated in one direction, the spring band is unwound and the driver rod is displaced in the driving direction. The return movement of the driver rod is effected by a separate device.

The driving member is a satellite of a planetary gear with the satellite in meshed engagement with the inner gear system of a ring gear. A pin supported in the center of the satellite engages with the driven member.

When the device is idling, the ring gear is freely rotatable so that rotation of the satellite around its axis causes rotation of the ring gear. By pressing the device against a work surface, the ring gear is prevented from turning in the housing by a sensing element and a clamping spring whereby the satellite, rotating around its own axis, rolls on the internal gearing of the ring gear and, as a result, rotates around the axis of the driving pinion forming the sun gear. Accordingly, the satellite provides rotational movement to the driven member.

A disadvantage of this driving device is that the driving force as well as the length of the driving stroke is determined by the intensity and the time period during which the device is pressed against the work surface. These factors are influenced manually by the operating personnel. Further, the return movement of the driving rod into its initial position is not possible via the driven member and, as a result, the above-mentioned separate means are required.

SUMMARY OF THE INVENTION

Therefore, the present invention is directed to a motor driven driving device of a simple construction which affords a complete drive stroke and return stroke of the drive rod without being influenced by outside factors.

In accordance with the present invention, a clutch for transmitting torque from the driving member to the driven member is selectively connectible with the two members by an actuating or triggering device for establishing a limited timewise connection of the clutch with the driving member and the driven member.

The engagement of the clutch with the driving member and the driven member must be maintained from the commencement of the drive stroke until the end of the return stroke so that the connection is limited to a given time period. A releasing device is provided for activating the clutch. Based on the arrangement of the device for converting the rotational movement to translational movement for the drive rod, the connection of the drive member and the driven member can be maintained over a part of a revolution, or for a complete revolution or several revolutions of the drive member. By actuating the releasing device, an automatically sequenced work cycle constituted by a driving stroke and a return stroke of the drive rod occurs.

Shiftable freewheeling clutches are suitable. Preferably, the clutch is designed as a partial revolution, a single revolution, or a multiple revolution clutch. A partial revolution clutch affords a connection between the driving member and the driven member only during a specific defined partial section of a revolution of the driving member. A single revolution clutch, however, maintains the connection during one complete revolution of the driving member. In a multiple revolution clutch the connection is maintained during a plurality of revolutions of the driving member.

It is advantageous if the clutch is a wraparound spring. The block of windings of the spring embraces the circumferential surfaces of a hub section on the driving member and another hub section on the driven member. Each hub section has an outer cylindrical shape of the same diameter, although a conical outer contour would be possible. The front ends of the hub sections facing one another are spaced as closely as possible without any mutual contact, to assure a wear-free rotation of the driving member with respect to the driven member while the device idles. The inside diameter of the windings of the slackened spring can be slightly smaller than the outside diameter of the circumferential surfaces of the hub sections. As a result, when the clutch is engaged the spring windings contact, with a slight prestressing, the circumferential surfaces of the hub sections. By rotating the driving member opposite to the winding direction of the wraparound spring, which is the operational direction of rotation of the driving member, the spring engages in a friction locking manner around the circumferential surfaces of the hub sections with a cable friction effect. For disengagement of the clutch the windings of the spring are arranged so that they do not tightly wrap around the hub sections. At most, only a frictional moment caused by prestressing of the wrap around spring acts on the hub sections.

Minimum wear is assured by forming the wraparound spring, in accordance with the present invention, from a wire with a rectangular cross-section. Each winding of the spring engages in a flat manner with the circumferential surfaces of the hub sections of the drive member and the driven member. By maintaining the space between the hub sections as small as possible, the individual windings of the spring are prevented from entering between the hub sections.

In accordance with another feature of the invention, one end of the wraparound spring is fixed to the driven member and the other end to a releasing device. While the releasing device holds one end of the spring stationary, the other end together with the driven member can turn through a small angle counter to the direction in which the spring is wound. This slight turning action is due, such as at the end of the return stroke, to the mass inertia of the parts participating in the driving operation and it causes an increase in the diameter of the individual winding so that friction-free rotatability of the hub section relative to the spring is achieved.

Another feature of the invention is that the end of the spring connected to the releasing device includes a shifting member which comprises engagement surfaces for a shifting finger on the releasing device. The end of the wraparound spring is bent radially and extends into a recess in the shifting member for affording a non-rotatable connection therebetween. If a single winding clutch is used, only one engagement surface for the releasing device is provided on the periphery of the shifting member. After one revolution of the shifting member, the engagement surfaces runs up against the shifting finger, to stop the shifting member and release the drive member from the driven member.

Preferably, the driven member has stop surfaces for engaging an arresting bolt. There are the same number of stop faces as engagement surfaces on the shifting member. By means of one stop face it is possible after one revolution of the driven member and the resulting drive stroke and return stroke of the drive rod, that the driven member is stopped exactly in a given rotational position. The stop faces and the engagement surfaces can be formed as shoulders in the outer surface of the driven member and the shifting member. It is also possible to provide stop faces or engagement surfaces on a protruding bolt or the like.

In still another feature of the present invention, the shifting finger is connected with the arresting bolt. Such a single part unit is advantageous from a design and functional point of view. To provide a completely wear-free arrangement of the clutch in the disengaged state and also to avoid energy losses, a clearance is established and maintained between the spring windings and the hub sections. This feature is achieved in another arrangement with the driven member forming a locking shoulder for the arresting bolt. The arresting bolt grips the locking shoulder from the rear at the end of the return stroke in a rotational position of the driven member with the spring tightened counter to the wrapping sense so that its windings are increased in diameter. Accordingly, the driving member is freely rotatable. In this rotational position of the driven member fixed by the arresting bolt, the arrangement for converting rotational movement into translational movement of the drive rod, for instance, by a connecting rod, holds the drive rod in a rearmost position.

The actuation of the releasing device can be accomplished in many ways, such as in a pure mechanical arrangement. In a simple dependable problem-free manner the actuation of the releasing device is effected, preferably by a spring or an electromagnet. While a spring accomplishes the engagement of the releasing device into the range of the engagement surfaces, the electromagnet serves for the impulse-like disengagement and thus the releasing or initiation of the installation operation.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

Figure 1:
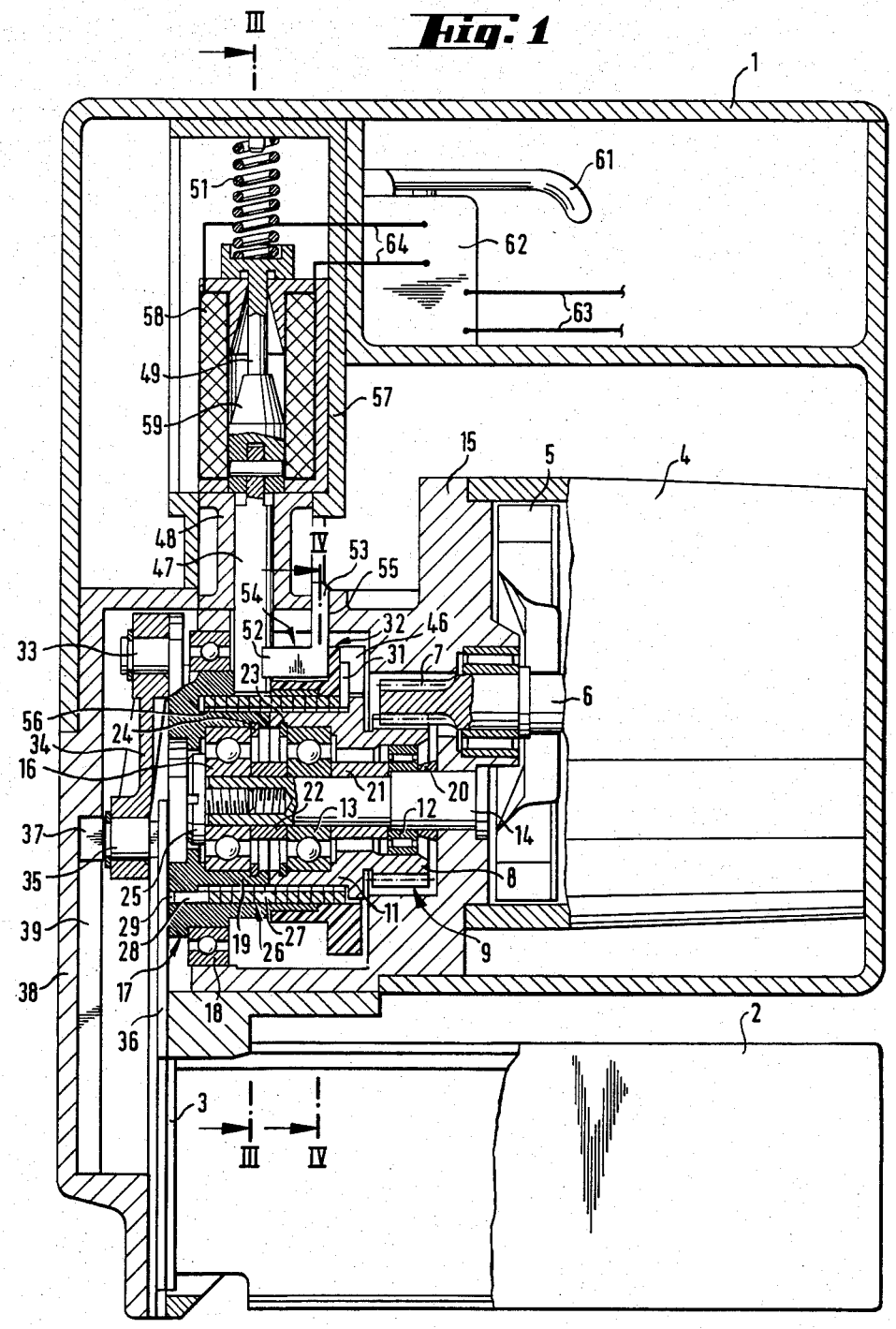
FIG. 1 is a driving device embodying the present invention, shown mostly in section, and being ready to drive a fastening element.

FIG. *3a* is an enlarged sectional view through the driving device taken along the line III—III in FIG. 1 and in position for carrying out the driving operation;

FIG. *3b* is a view similar to that illustrated in FIG. *3a* but showing the arrangement of the device after the actuation of the driving stroke;

FIG. *4a* is an enlarged and simplified sectional view taken along the line IV—IV in FIG. 1 with the device in position for driving; and FIG. *4b* is a view similar to FIG. *4a*, however, showing the driving device after the release of the driving stroke.

DETAILED DESCRIPTION OF THE INVENTION

A device for driving fastening elements, such as nails, staples and the like, is shown in FIG. 1 and the device includes a housing 1 with a magazine 2 for supplying the staples 3 to be driven. An electromotor 4 is supported in the housing and includes a fan wheel 5, a rotor shaft 6 and a pinion 7. Pinion 7 meshes with a gear wheel 8 forming part of a drive member 9. Drive member 9 has a hub section 11 and is rotatably supported on an axle 14 by a pair of spaced bearings 12, 13 and the axle is fixed in a motor housing 15. A driven member 17 is rotatably mounted on the axle 14 by an additional bearing 16. An outer bearing 18 positioned in the housing 1 serves for additional support of the driven member 17. The driven member 17 has a hub section 19 having the cylindrically shaped circumferential surface as does the hub section 11.

Bushings 20, 21 and 22 as well as safety rings 23, 24 serve to maintain the spaced support of the bearings 12, 13, 16. A screw 25 retains the overall bearing unit on the axle 14.

The drive member 9 and the driven member 17 can be connected, so that they rotate together, by a clutch in the form of wraparound spring 26. One end 28 of the spring 26 extends into an axial bore 29 in the driven member 17, while the other end 31 is locked in rotatational engagement with a shifting member or ring 32, the shifting member is concentrically arranged on the driven member 17 so that it can rotate on the driven member.

Driven member 17 has a crankpin 33 to which a connecting rod 34 is articulated. The opposite end of the connecting rod 34 from the crankpin has a follower pin 35 extending transversely of it and the follower pin is fixed to a driver rod 36. Follower pin 35 has an end section 37 projecting outwardly from the connecting rod and it is guided in the longitudinal groove 39 in a front plate 38 of housing 1 for carrying out translational movement.

Figure 2:
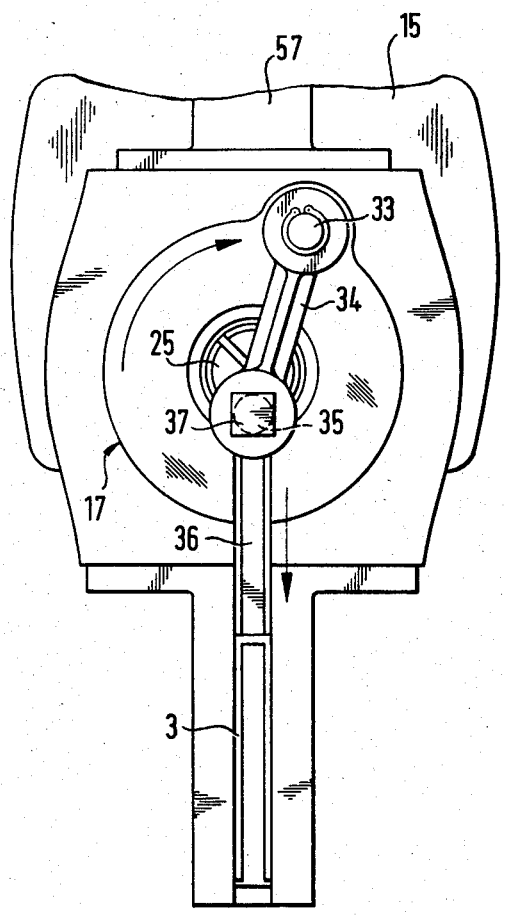
FIG. 2 is a partial schematic front view of the device shown in FIG. 1 taken from the left side with the front plate removed, at the commencement of the driving stroke.

When the driven member rotates, the crankpin revolves, as shown in FIG. 2, in the direction of the arrow and carries the connecting rod 34 with it. The connecting rod converts the rotational movement of the crankpin into the translational movement of the drive rod for its drive stroke and return stroke.

Figure 3A:
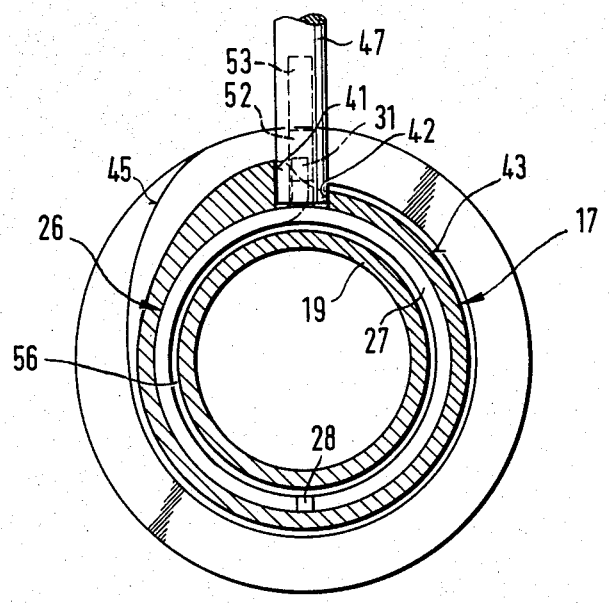

As shown in FIG. 3*a*, driven member 17 has a stop face 41 on its outer surface in the winding direction of the wraparound spring 26. Further, a blocking shoulder 42 is provided in the region of the stop face 41 and is formed by a radial bore. Stop face 41 adjoins one end of a link track 43 which track extends around the outer surface of the driven member.

Figure 4A:
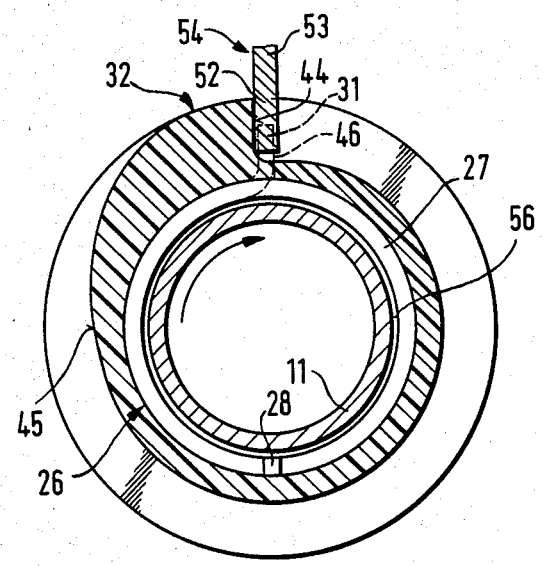

As shown in FIG. 4*a*, switching member or ring 32 has an engagement face 44 facing in the winding direction of the spring 26 and a link track 45 extends around the surface of the switching ring. A slit-shaped recess 46 in the switching ring 32 permits the engagement of a radially bent over end of the wraparound spring 26 formed at an angle 31.

Figure 3B:
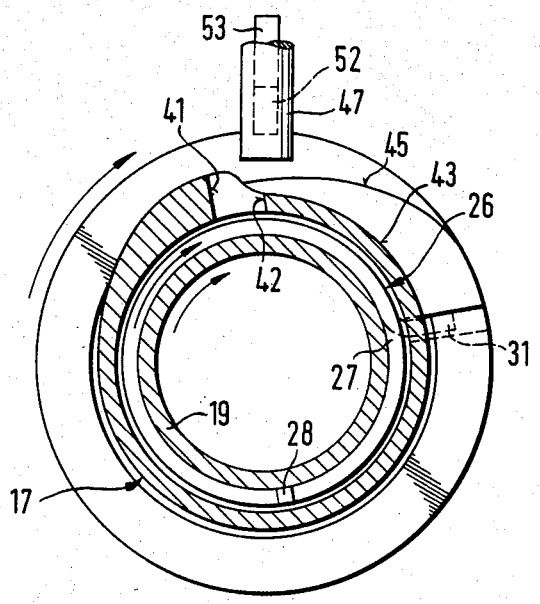

In the position shown in FIGS. 1, 3*a* and 3*b* with the device ready to drive a fastening element, the stop face 41 of the driven member and the locking shoulder 42, as illustrated particularly in FIG. 3*a*, abuts a rod-shaped arresting bolt 47. The arresting bolt 47 is displaceably mounted in a bearing bushing 48, note FIG. 1, fixed on one side of the housing and is maintained in the illustrated engaged position by a spring 51 with an extension piece 49 interposed between them. The engagement face 44 on the switching ring 32 also contacts a switching finger 52, in the form of a transverse beam, which is provided as a single structural unit with the arresting bolt 47. The switching finger 52 and an arm 53 projects outwardly from the finger in the actuating direction and provides the releasing device 54.

To prevent turning of the switching finger 52 and the arresting bolt 47 around the axis of the arresting bolt, arm 53 projects into a guide opening 55 on the side of the housing. This arrangement which prevents turning is required, because in the position ready for inserting a fastening element, the wraparound spring 26 is tightened by about a quarter of a revolution opposite to the winding direction. Accordingly, the switching ring 32 acts by means of its engagement surface 44 with tensile force on the projecting switching finger 52. In this tension position of the spring 26, the inner surface of the windings 27 of the spring are spaced radially from the circumferential surfaces of the hub sections so that a circular gap 56 is formed between the spring and the hub sections.

Disengagement of the switching finger 52 and the arresting bolt 47 is achieved by an electromagnet 58 fixed on a cage 57 provided on a side of the housing. If the electromagnet is switched on, an armature 59 assigned to the extension piece 49 is pulled into the electromagnet opposite to the biasing force of the spring 51.

Figure 4B:
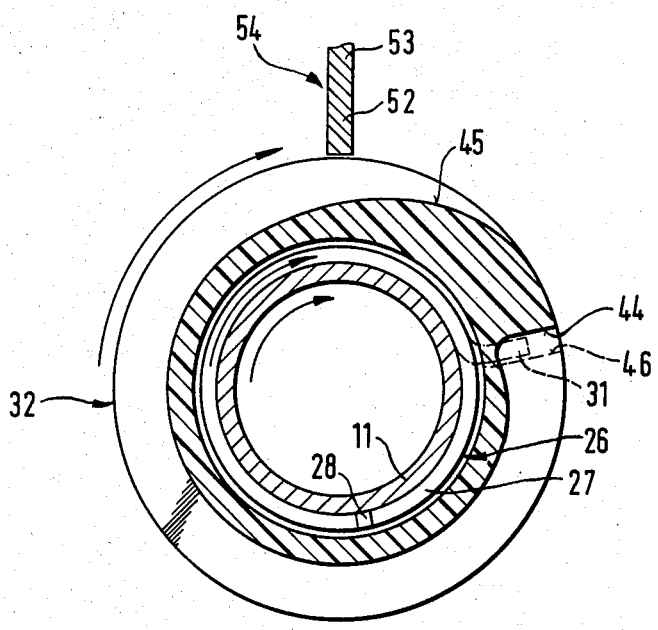

As shown in FIGS. 3*b* and 4*b*, the engagement surface 44 and the stop face 41 are released by the disengagement of the switching finger 52 and the arresting bolt 47 so that the tightened spring 26 slackens partially with a simultaneous reduction in diameter so that the inner surface of the windings 27 bear against the circumferential surfaces of the hub sections 11 and 19. The switching ring 32 turns during the slackening of the spring 26 with respect to the driven member 17 by a quarter of a revolution, as can be seen by comparing FIGS. 4*a* and 4*b*.

The inner surface of the spring windings 27 bear with a certain prestress against the circumferential surface of the hub section with a rotating motion being imparted to the hub section by the motor 4 with the hub section carrying the spring 26 due to a frictional locking arrangement, moving in a direction counter to the winding direction. Torque is transmitted by the wraparound spring 26 to the hub section 19 on the driven member 17. The driven member 17 then drives the drive rod 26 by means of the connecting rod 34.

The disengagement of the switching finger 52 and the arresting bolt 47 takes place in the manner of an impulse whereby directly following the releasing impulse caused by the electromagnet 58, the electromagnet is switched off and the switching finger 52 and the arresting bolt 47 move against the connecting link tracks 43, 45 due to the action of the spring 51. The wraparound spring 26 fixed on the rotating hub sections 11, 19 also rotate the switching ring 32. After approximately three-quarters of a revolution of the switching ring 32, its engagement surface 44 moves against the switching finger 52 so that the rotating motion of the spring 26 stops. The driven member 17 and the parts connected to it continue to run in the direction of rotation because of their mass inertia, until after approximately a further one-quarter of a turn, the stop face 41 trailing the engagement face 44 contacts the arresting bolt 47 whereby the rotational movement of the driven member 17 is discontinued. By further rotation of the driven member relative to the switching ring 32, the spring 26 with its ends fixed to these parts, expands in diameter of the windings to the arrangement displayed in FIGS. 1, 4*a* so that a circular gap 56 is formed between the spring windings and the hub sections 11, 19. Thus, the rotational connection between the driving member and the driven member is broken.

To prevent the existing tensile force in the wraparound spring 26 from causing a reverse rotation of the driving member 17, the arresting bolt is biased by the spring 51 in front of the blocking shoulder 42 directly after the engagement surface 41 runs into contact with the bolt. Accordingly, the device is returned into position ready to install another fastening element with the drive rod 36 assuming the rearmost position. A staple 3 provided for the next insertion operation can be moved out of the magazine channel 2 into the path of the driving rod 36. As described above, other driving steps can be actuated by a trigger 61. The trigger 61 acts on an electric impulse switch 62 shown schematically and the switch feeds current supplied via a lead wire 63 from an energy source as an impluse to the electromagent 58 for activation over the connecting wires 64.

While specific embodiments of the invention have been shown and described in detail to illustrate the application of the inventive principles, it will be understood that the invention may be embodied otherwise without departing from such principles.

We claim:

1. Device for driving nails, staples and similar fastening elements comprises an axially extending driving member having an axially extending cylindrically shaped surface concentric with the axis thereof, a motor arranged to rotate said driving member, an axially extending driven member disposed in axial alignment with and extending axially from adjacent one end of said driving member, said driven member having an axially extending cylindrically shaped surface concentric with the axis thereof, means connected to said driven member for converting rotational movement into translational movement, clutch means for selectively interconnecting the cylindrically shaped surfaces of said driving member and said driven member for transmitting torque from said driving member to said driven member, and a relasing device for providing a limited timewise connection between said driving member and said driven member via said clutch means, said clutch means comprises an axially extending wraparound spring encircling the cylindrically shaped surfaces of said driving member and driven member and arranged to grip the cylindrically shaped surfaces of said driving member and driven member for transmitting the rotational driving motion of said driving member to said driven member.

2. Device, as set forth in claim 1, wherein said wraparound spring has a pair of opposite ends with one end fixed to said driven member and the other end secured to the releasing device.

3. Device, as set forth in claim 2, wherein said releasing device includes a switching finger, a switching ring has engagement surfaces for said switching finger, and the end of said wraparound spring engaged with said releasing device is connected with said switching ring.

4. Device, as set forth in claim 1, wherein said wraparound spring is formed of a wire having a rectangular cross-section.

5. Device, as set forth in claim 4, wherein said wraparound spring has a pair of opposite ends with one end fixed to said driven member and the other end secured to the releasing device.

6. Device, as set forth in claim 5, wherein said releasing device includes a switching finger, a switching ring has engagement surfaces for said switching finger, and the end of said wraparound spring engaged with said releasing device is connected with said switching ring.

7. Device, as set forth in claim 5, including an arresting bolt, said driven member has a stop face thereon for engagement with said arresting bolt.

8. Device, as set forth in claim 7, wherein said switching finger is connected to said arresting bolt.

9. Device, as set forth in claim 6, wherein said driven member includes a blocking shoulder for contacting said arresting bolt.

10. Device, as set forth in claim 7, wherein said releasing device includes a spring for actuating the releasing device.

11. Device, as set forth in claim 7, wherein said releasing device includes an electromagnet for actuating the releasing device.

* * * * *